United States Patent [19]

Hauser

[11] 3,998,509

[45] Dec. 21, 1976

[54] CASE AND CORNER FASTENER THEREFOR

[76] Inventor: Jon W. Hauser, 3N981 Rte. 31, St. Charles, Ill. 60174

[22] Filed: July 28, 1975

[21] Appl. No.: 599,529

[52] U.S. Cl. ..... 312/263; 312/140.4; 24/81 B

[51] Int. Cl.[2] ..... A47B 47/00; F16B 12/00

[58] Field of Search ..... 312/140, 140.3, 140.4, 312/263, 257 R; 24/81 B, 81 BF, 73 PC

[56] References Cited

UNITED STATES PATENTS

| | | | |
|---|---|---|---|
| 2,168,911 | 8/1939 | Meyer | 24/73 PC |
| 2,228,221 | 1/1941 | Bales | 24/81 B |
| 3,822,924 | 7/1974 | Lust | 312/263 |

*Primary Examiner*—Casmir A. Nunberg

*Attorney, Agent, or Firm*—Edmond T. Patnaude

[57] ABSTRACT

Eight identical fasteners receive the corner portions of six rectangular sheets to maintain the sheets and fasteners in interlocked assembled relationship.

9 Claims, 3 Drawing Figures

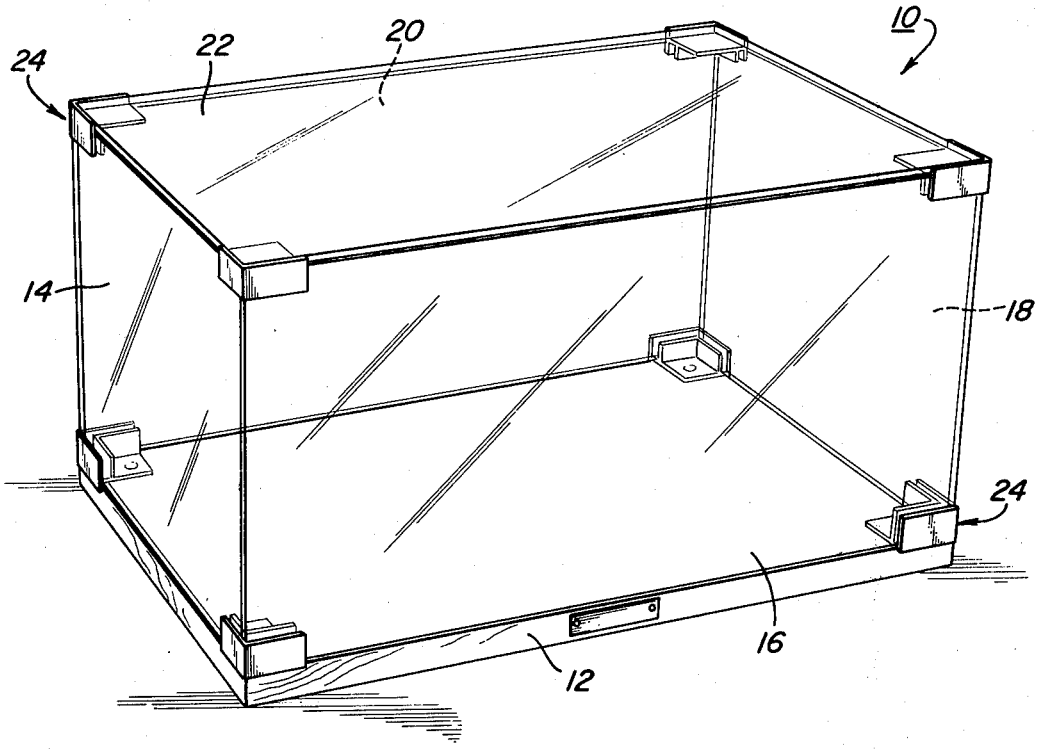
FIG. 1
FIG. 2
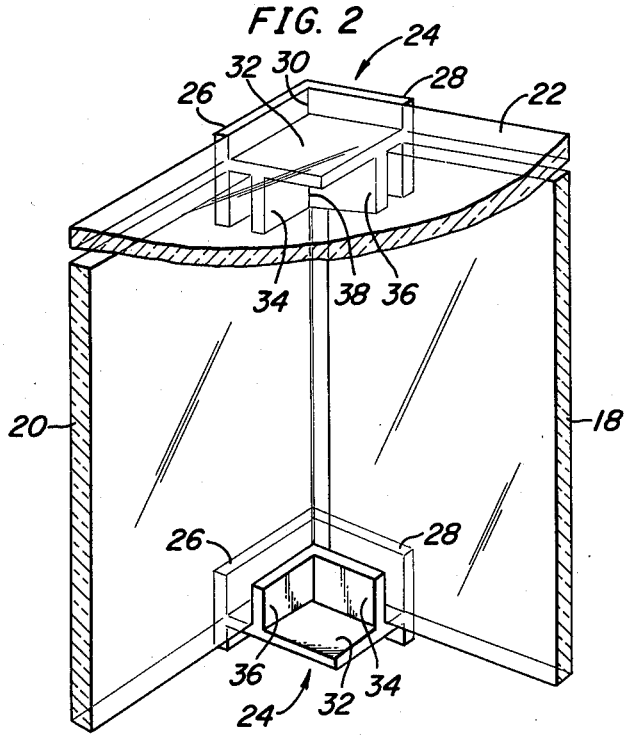
FIG. 3
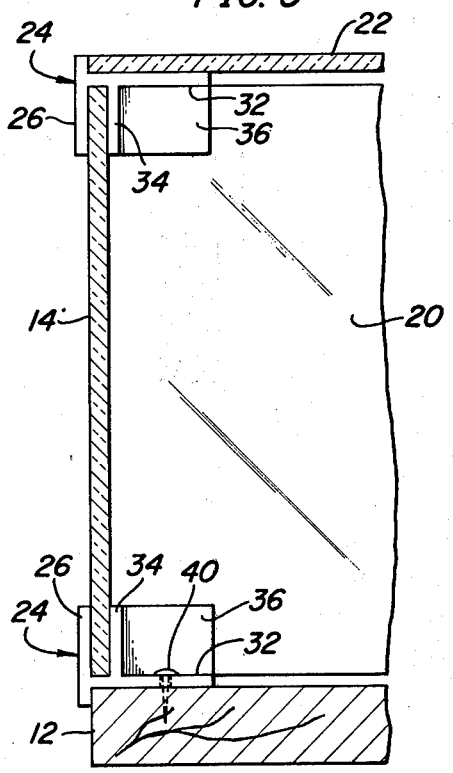

CASE AND CORNER FASTENER THEREFOR

The present invention relates in general to fasteners for rectangular cases, and it relates more particularly to a new and improved corner fastener and display case utilizing a plurality of the fasteners.

BACKGROUND OF THE INVENTION

Display cases as used, for example, for protecting ornamental articles generally comprise a plurality of glass or clear plastic sheets fastened together to enclose the article to be displayed. Such display cases commonly include a preformed cover which fits onto a base over the article to be displayed and are thus relatively bulky to transport and store. Accordingly it would be desirable to provide a display case which could be transported in knocked-down form and easily assembled without the use of special tools and the like.

Cases having glass sides have included corner fasteners for interconnecting the sides with a base or table surface to which the fasteners are connected. For example, U.S. Pat. No. 2,228,221 discloses such a fastener. These corner fasteners of the prior art would, however, if used in a display case obstruct the view of the article on display, and moreover, other means would be required for attaching the top to the case. It would be desirable, therefore, to provide a corner fastener which can be used at all eight corners of a rectangular case to hold the entire case in assembled relationship.

SUMMARY OF THE INVENTION

Briefly, there is provided in accordance with one aspect of the present invention a new and improved fastener for interlocking the corner portions of three, mutually orthogonal rectangular sheets. In accordance with another aspect of the invention there is provided a novel knock-down rectangular display case employing identical ones of the said improved fasteners at all eight corners to interlock all six sides of the case together.

BRIEF DESCRIPTION OF THE DRAWING

Further objects and advantages and a better understanding of the present invention can be had by reference to the following detailed description, wherein:

FIG. 1 is a perspective view of a display case embodying the present invention;

FIG. 2 is an enlarged view of a portion of the case of FIG. 1 particularly showing the construction of the corner fasteners; and FIG. 3 is a vertical section taken through the left hand side of a similar case to that of FIG. 1.

DETAILED DESCRIPTION OF THE INVENTION

While the present invention is described herein as embodied in a display case, it will be understood that the corner fastener has other applications, and cases embodying the present invention may be used for purposes other than display. Therefore, the invention is not to be construed as limited to display cases or to fasteners for use only therewith.

Referring to FIG. 1 there is shown a display case 10 including a rectangular base member 12, four side members or panels 14, 16, 18 and 20 and a top member or panel 22. Eight identical corner fasteners 24 are respectively provided at the corners and interlock the panels and base together. The side and top members are preferably glass or clear plastic sheets of the same thickness. As shown, the base member 12 is thicker than the side and top members for reasons of esthetics but can, if desired, be of the same thickness and might also be transparent.

With particular reference to FIG. 2 wherein two of the fasteners 24 are illustrated, it may be seen that each fastener 24 is a unitary integral part which may, for example, be an injection molded plastic part. It includes a pair of upright rectangular side walls 26 and 28 extending in mutually perpendicular relationship and joined together along a common vertical edge 30. A horizontal planar ledge 32 extends inwardly from the side walls intermediate the top and bottom edges of the walls 26 and 28. As may best be seen by reference to the upper clip 24 as shown in FIG. 2, the ledge 32 is spaced from one horizontal edge of the walls 26 and 28 by a distance but slightly greater than or equal to the thickness of the top panel 22.

A pair of flanges 34 and 36 extend from one side of the ledge 32 in parallel relationship with respective ones of the side walls 26 and 28 and are joined together at the corner 38. These flanges 34 and 36 are spaced from the walls 26 and 28 by a distance slightly greater than the thickness of the side panels 14, 16, 18 and 20 so as to receive the side panels and hold them in place.

In order to assemble a display case constructed in accordance with the present invention, the rectangular base member 12 is placed on a supporting surface and four of the fasteners 24 are placed on the corners of the base member with the flanges 34 and 36 extending upwardly. The side members 14, 16, 18 and 20 are then inserted into the grooves between the flanges 34 and 36 and the side walls 26 and 28 of the fasteners. Four more of the fasteners are then placed at the respective upper corners with the flanges 26 and 28 extending along the outside of the side members and the flanges 34 and 36 extending on the inside. It may be seen that as thus far assembled the side members and the fasteners are interlocked and held together by gravity. The top panel member 22 may then be lowered onto the clips so that its corner portions rest on the respective ledges 32 to hold the top clips in place and complete the case.

In order to avoid spurious disassembly of the case 10, the spacing between the flanges 34 and 36 and the side walls 26 and 28 may be such as to provide a press fit between the fasteners and the side members 14, 16, 18 and 20. By molding the fasteners of a plastic which has some resiliency, the slight draft between the flanges 34 and 36 and the walls 26 and 28 which is necessary to permit removal of the part from the mold, provides a suitably tight fit between the fasteners and the case sides to which they are secured. Where a tight fit between the fasteners and the side members is provided it may also be desirable to secure the four bottom fasteners to the base member 12. Accordingly, in accordance with the embodiment of the invention shown in FIG. 3, the ledge 32 is perforated to receive a screw, nail or similar fastener 40 to secure each of the four lower fasteners to the base member 12. When this latter embodiment of the invention is used, the case 10 can be lifted by the sides without becoming spuriously disassembled. While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed is:

1. A corner clip for interconnecting the adjoining corner portions of a plurality of orthogonally disposed panels forming a six sided enclosure, said clip comprising a one piece member having a horizontally disposed ledge with horizontal top and bottom planar surfaces and one pair of mutually orthogonal side edges, a pair of upright side walls joined together at one vertical edge and disposed in mutual perpendicular relationship, the inner surface of each of said side walls being planar and vertical, said side walls having top and bottom terminal edges located exteriorly of the respective planes of said inner surfaces of said side walls, said side walls respectively joining said side edges of said ledge at locations intermediate said top and bottom edges of said side walls, and first and second vertical flanges extending from one surface only of said ledge in spaced parallel relationship with respective ones of said side walls, whereby two of said three panels may be respectively disposed between said flanges and said walls and the corner portion of the other of said three panels may lie against the other side of said ledge with the edges thereof abutting said side panels.

2. A corner clip according to claim 1 wherein the spacing between said flanges and said side walls and the spacing from the other surface of said ledge to the next adjacent horizontal edge of said side walls are substantially equal.

3. A corner clip according to claim 1 wherein said first and second flanges are mutually interconnected along one edge.

4. A corner clip according to claim 1 wherein said clip is a unitary plastic part.

5. A corner clip according to claim 4 wherein said side walls, said flanges and said ledge are rectangular.

6. A corner clip according to claim 5 wherein said ledge is perforated.

7. A case, comprising eight corner slips according to claim 1, six rectangular panel members, constituting top, bottom and sides arranged in a hollow rectangular solid and held together at the corners by said corner clips.

8. A case according to claim 7 wherein said side members are tightly fitted between said flanges and said side walls of said fasteners.

9. A case according to claim 8 wherein four of said fasteners are secured to said bottom member.

* * * * *